US006434915B1

(12) United States Patent
DeCosemo

(10) Patent No.: US 6,434,915 B1
(45) Date of Patent: Aug. 20, 2002

(54) TREELESS AND GULLETLESS SADDLE AND METHOD OF MAKING THE SAME

(76) Inventor: Peter A. DeCosemo, 1410 S.E. 35th Ave., Portland, OR (US) 97214

( * ) Notice: Subject to any disclaimer, the term of this patent is extended or adjusted under 35 U.S.C. 154(b) by 4 days.

(21) Appl. No.: 09/615,472

(22) Filed: Jul. 13, 2000

(51) Int. Cl.[7] ..... B68C 1/02; B68C 1/08
(52) U.S. Cl. ..... 54/44.1; 54/44.5
(58) Field of Search ..... 54/44.1, 44.3, 54/44.5, 44.7, 46.1

(56) References Cited

U.S. PATENT DOCUMENTS

| | | | | |
|---|---|---|---|---|
| 4,061 A | | 5/1845 | Caldwell | |
| 47,771 A | | 5/1865 | Meeker et al. | |
| 233,816 A | | 10/1880 | Straus | |
| 270,142 A | | 1/1883 | Spencer | |
| 3,286,440 A | | 11/1966 | Walker et al. | |
| 4,265,075 A | * | 5/1981 | Motsenbocker | 54/44.5 |
| 4,502,266 A | * | 3/1985 | Friedson | 54/46.1 |
| 4,524,570 A | * | 6/1985 | Racinet | 54/44.5 |
| 4,716,715 A | | 1/1988 | Johnson | |
| 5,187,924 A | * | 2/1993 | Marshall | 54/44.5 |
| 5,456,072 A | | 10/1995 | Stern | |
| 5,740,665 A | * | 4/1998 | Belton | 54/44.1 |
| 6,272,817 B1 | * | 8/2001 | Further | 54/44.1 |

FOREIGN PATENT DOCUMENTS

GB 625934 7/1949

* cited by examiner

*Primary Examiner*—Charles T. Jordan
*Assistant Examiner*—Elizabeth Shaw
(74) *Attorney, Agent, or Firm*—Ingrid McTaggart

(57) ABSTRACT

A treeless and gulletless saddle comprises a layered arrangement of flexible leather and foam, without including a rigid saddletree or frame. In particular, the inventive saddle comprises two lower body half sections sewn together to define a saddle body. An underside of said saddle body is in form fitting continuous contact with the back of the horse across the full surface area of a central contact region. The saddle further comprises additional layers of soft leather and foam shaped to define an upwardly extending pommel, an upwardly extending cantle, and a lowered seat area positioned therebetween. The arched and contoured shape of the saddle, therefore, is defined by soft foam and leather and not by a rigid steel or wooden internal frame.

21 Claims, 12 Drawing Sheets

Fig. 1
(PRIOR ART)
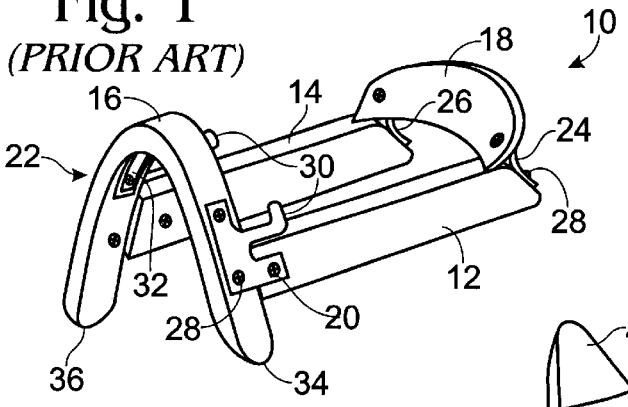
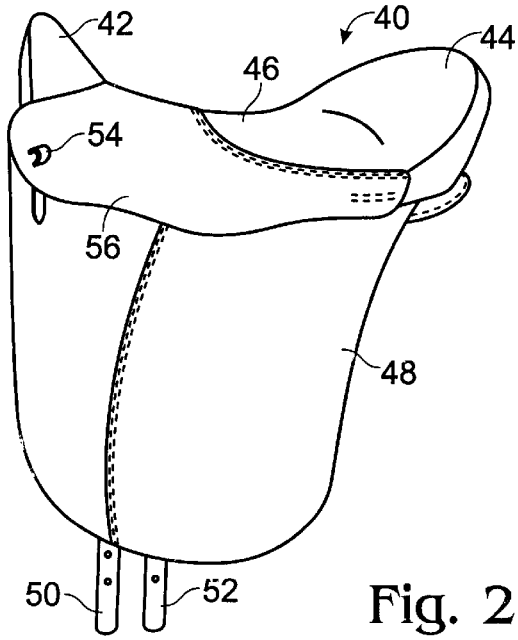
Fig. 2
Fig. 4
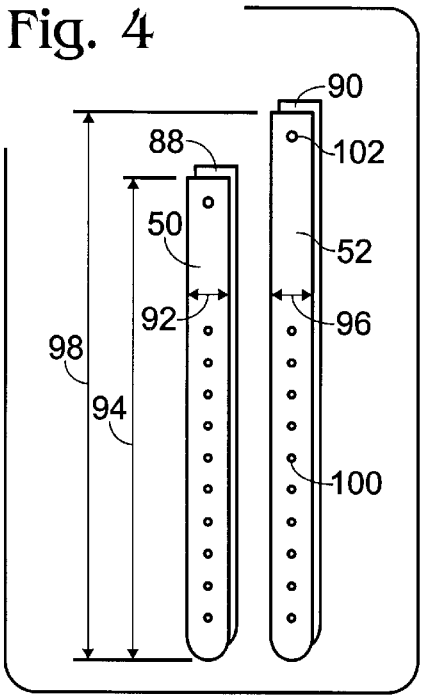
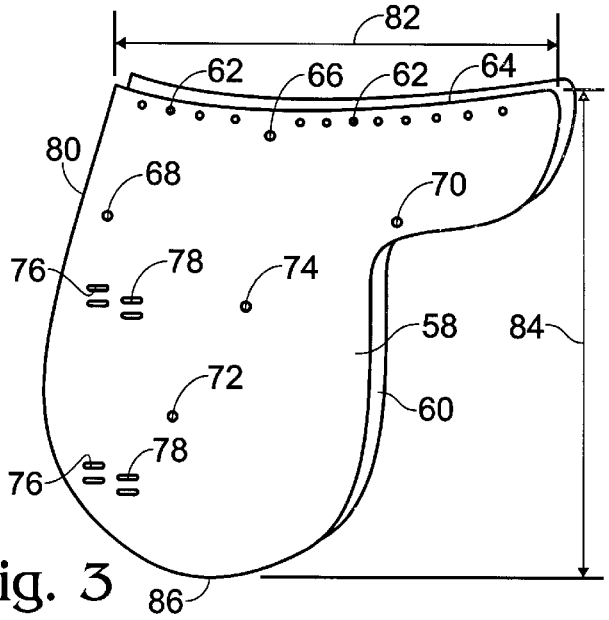
Fig. 3

Fig. 9
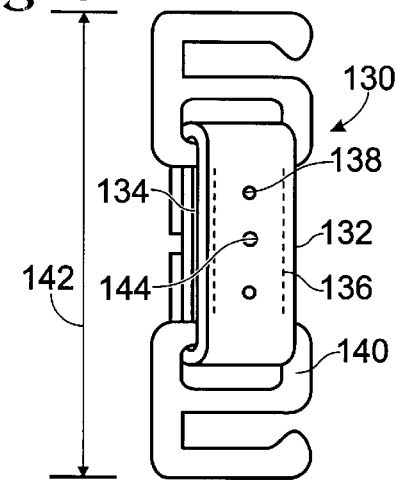
Fig. 10
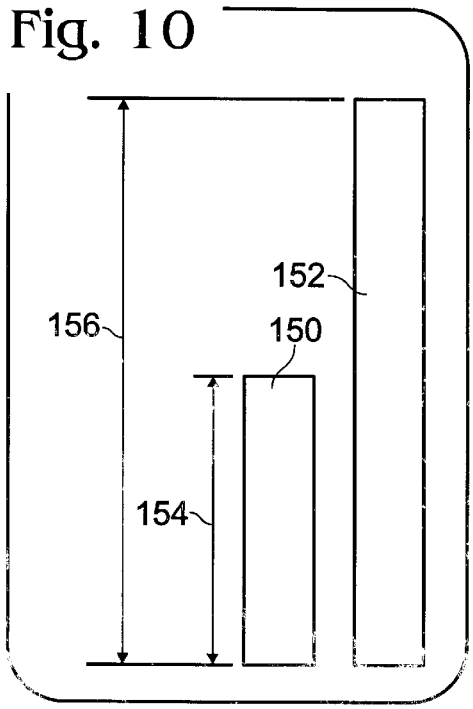
Fig. 12
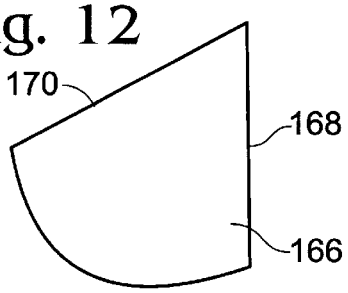
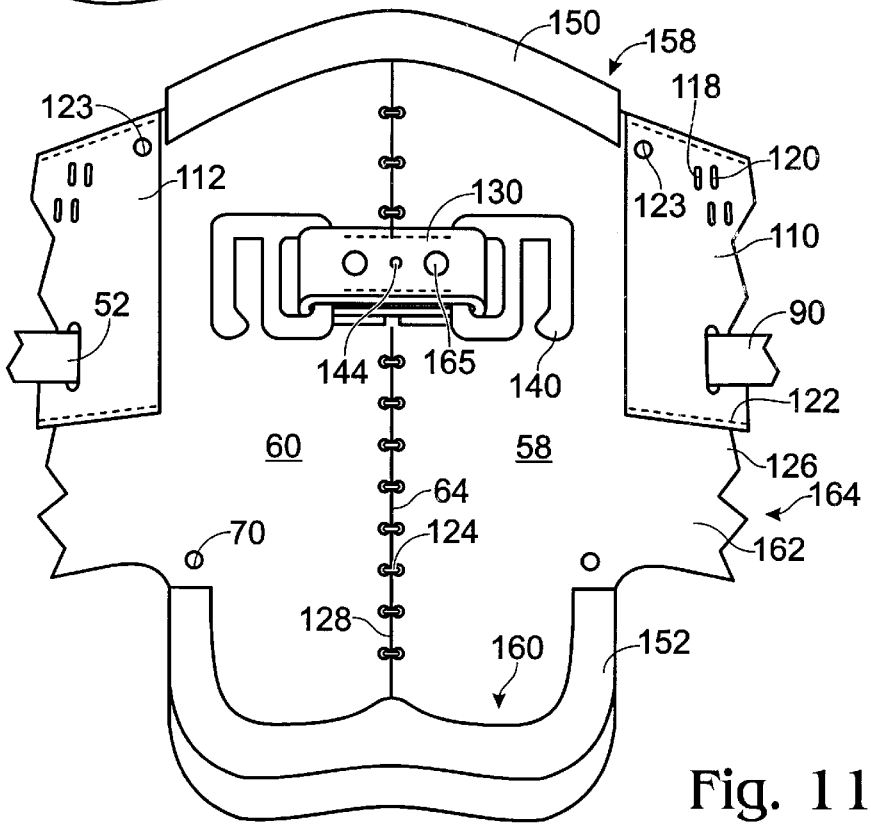
Fig. 11

Fig. 19
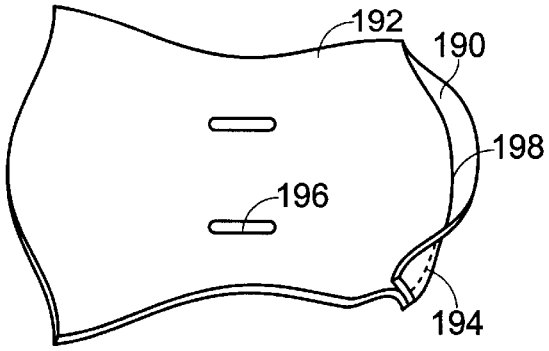
Fig. 22
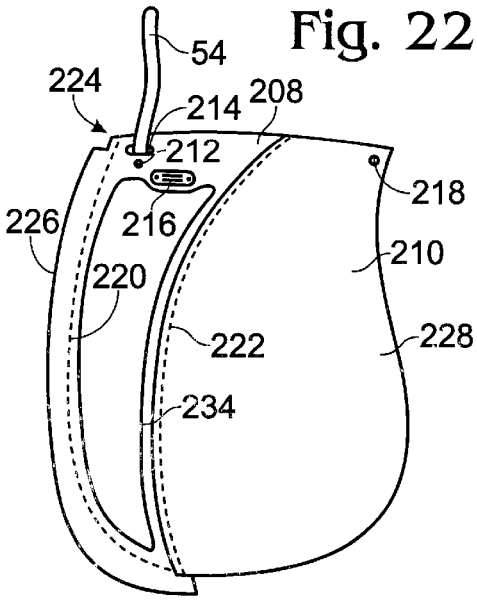
Fig. 21
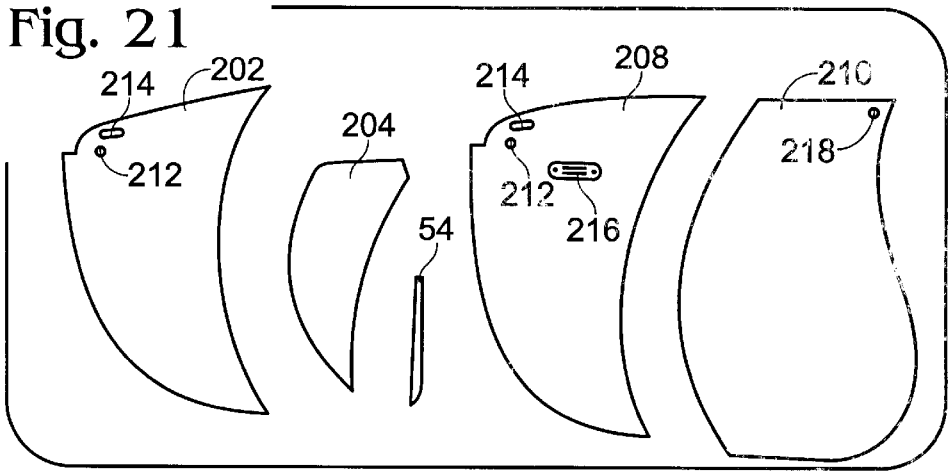
Fig. 24
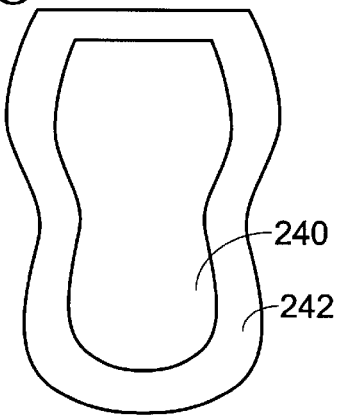
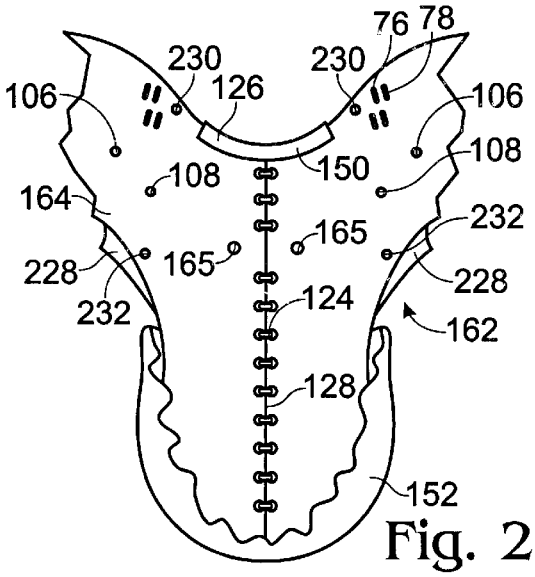
Fig. 25

Fig. 23
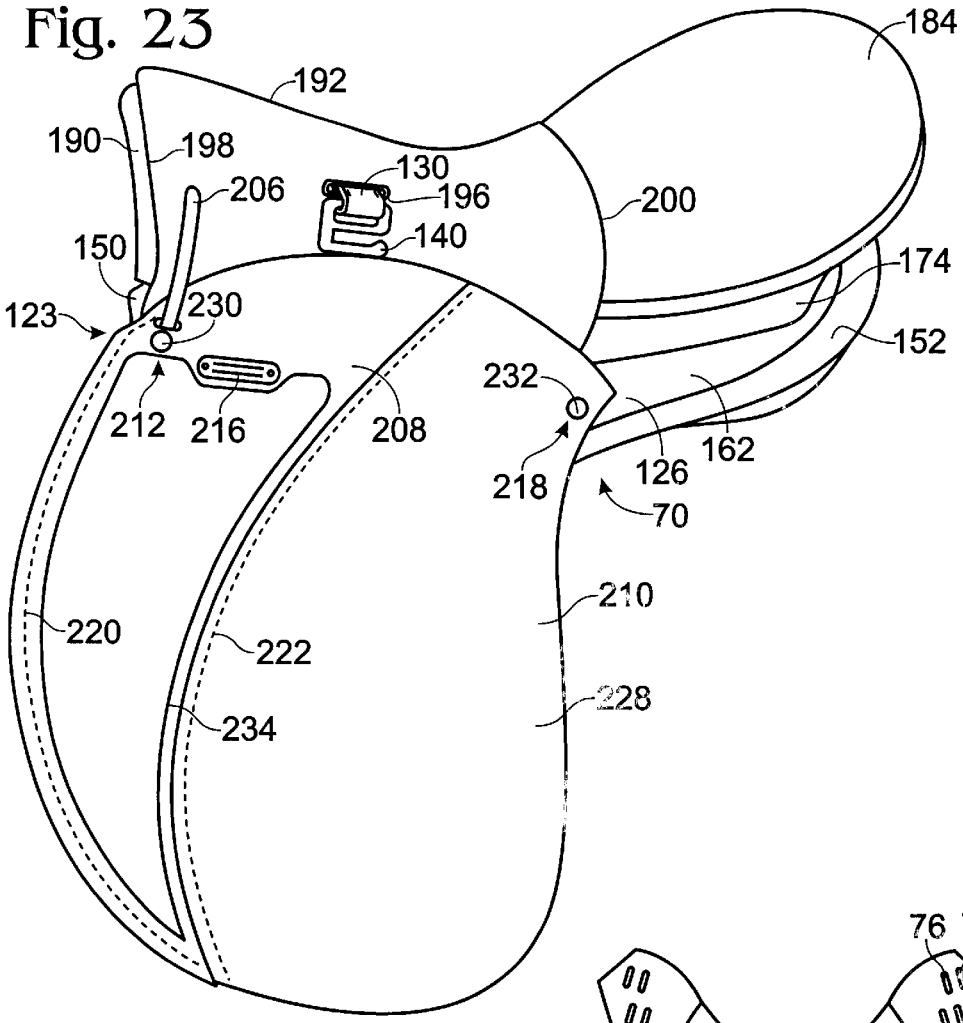
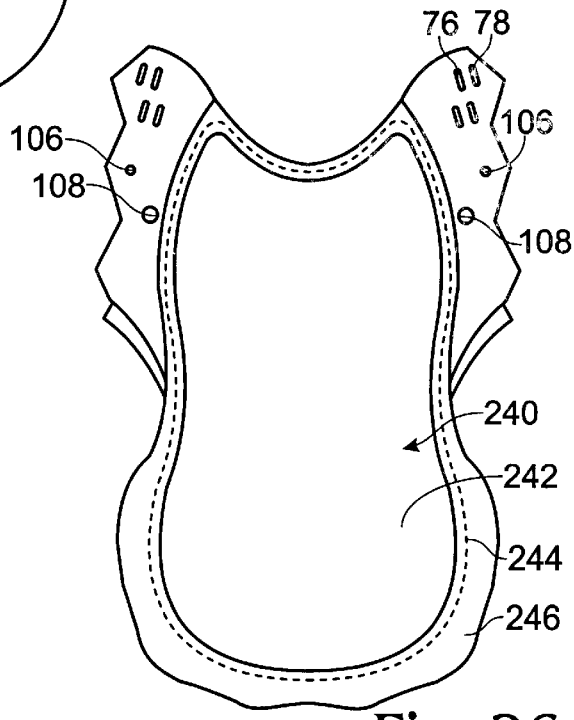
Fig. 26

Fig. 27
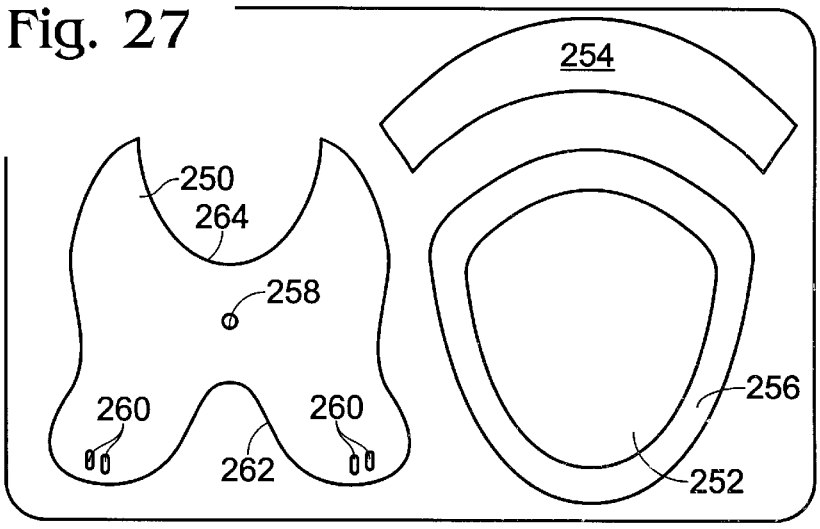
Fig. 29
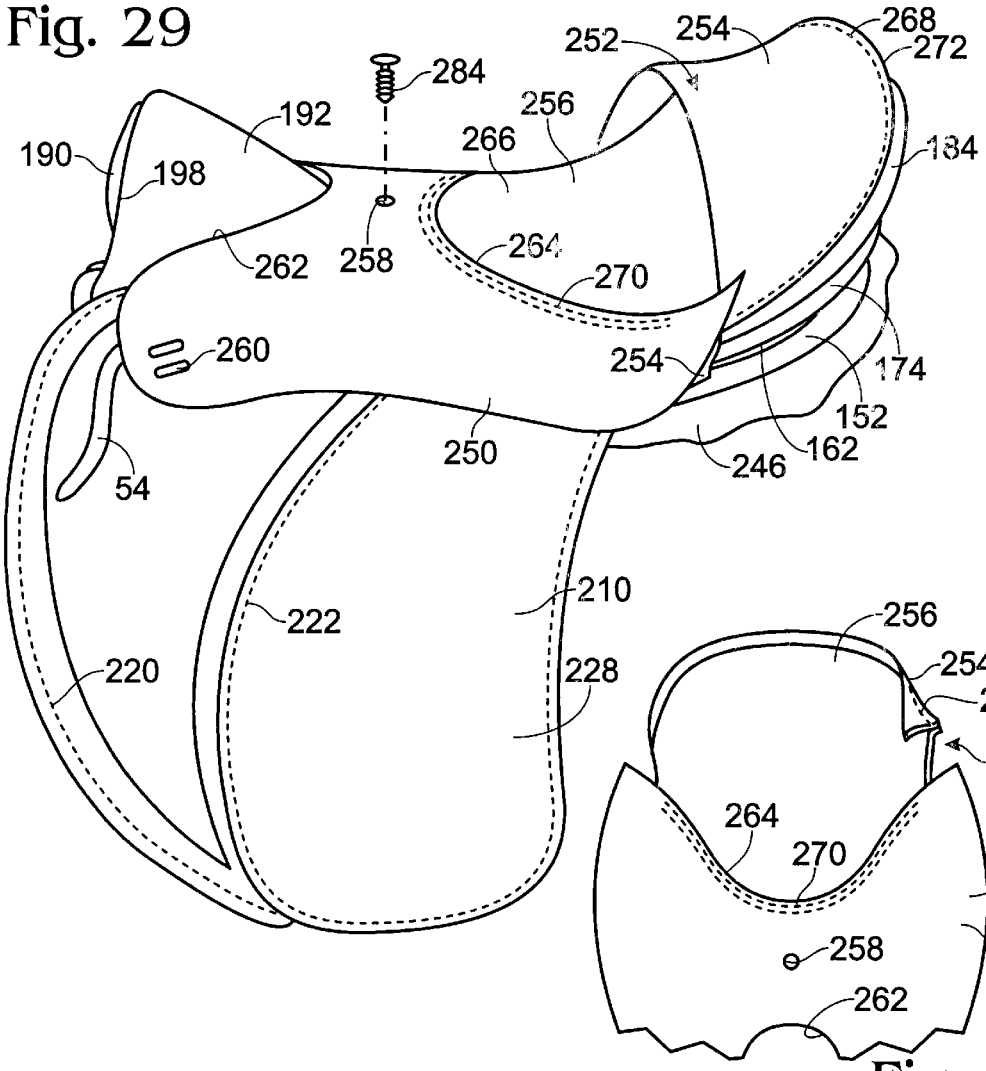
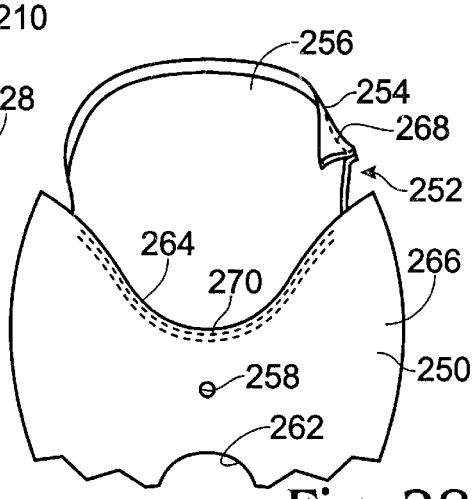
Fig. 28

TREELESS AND GULLETLESS SADDLE AND METHOD OF MAKING THE SAME

TECHNICAL FIELD

The present invention relates to a treeless and a gulletless saddle and a method of making the same, and more particularly, to a treeless and gulletless saddle that provides a fully flexible saddle which conforms to and continuously contacts a horse's back over the horse's spine during all types of movement, while simultaneously providing contoured support for a rider which enables the rider to fully communicate with the horse.

BACKGROUND OF THE INVENTION

Throughout history saddles have facilitated riders in remaining mounted on their horse. Early saddles comprised a simple, flat saddle blanket secured to the back of a horse. This simple design facilitated the rider in remaining on the horse during calm movements, such as walking, but did not help the rider to remain on the horse during faster movements such as galloping or jumping. With the arrival of organized warfare a more substantial saddle was developed which included a rigid saddletree that anchored a soldier in the saddle and rendered him difficult to dislodge by his opponents.

These rigid saddletrees were thought to distribute the weight of the rider evenly over the horse's back and to provide a gullet, i.e., a spacing of the saddle from the backbone ridge of the horse. This rigid frame design with a gullet was thought to ease the workload of the horse. Spacing of the rigid frame from the horse's backbone ridge was also though to evenly distribute the weight of the rider. Rigid saddletrees were also thought to provide the rider with a stable support base from which to control the horse by providing a permanent arched shape to the saddle including a raised pommel, a raised cantle and a lowered seat area positioned therebetween. Due to these perceived benefits, rigid saddletrees having gullets, i.e., spacing between the saddle and the backbone ridge of the horse, have become standard in virtually all saddle designs.

Rigid saddletrees, however, have several disadvantages. During riding the rigid frame is forced downwardly into and against the horse's back and shoulders by the weight of the rider. This rubbing and downward force of the rigid saddletree can result in saddle sores to both horse and rider. In more extreme cases, the rigid frame substantially limits performance of the horse by preventing free movement of the horse's front legs at the shoulders. Another disadvantage is that saddles manufactured with rigid saddletrees do not conform to the shape of the horse so that with each movement of the horse, such as breathing and striding, the frame is forced against the horse's back and sides. Moreover, due to the expense of manufacturing saddles, only a single sized rigid saddle may be available for a variety of horses each having a unique size. Additionally, the gullet design of prior art saddles tends to concentrate the entire load of the rider at two contact points on either side of the horse's back, which may strain or injure the horse.

SUMMARY OF THE INVENTION

Accordingly, an object of the present invention is to provide a fully flexible, treeless and gulletless saddle which conforms to the shape of a horse's back.

Another object of the present invention is to provide a treeless saddle that provides contoured support for a rider and which enables the rider to fully communicate with the horse.

Still a further object of the present invention is to provide a treeless saddle that is substantially more comfortable for both horse and rider.

Yet another object of the present invention is to provide a treeless saddle having an outer shape and design which conforms to international riding regulations.

Still another object of the present invention is to provide a flexible saddle that conforms to the shape of each individual horse, regardless of the horse's size.

A further object of the present invention is to provide a treeless saddle that does not contact the shoulders of the horse.

Accordingly, the treeless and gulletless saddle of the present invention preferably comprises a layered arrangement of flexible leather and foam, and does not include a rigid saddletree or frame, or spacing between the saddle and the horse's back. In particular, the inventive saddle comprises two lower body half sections sewn together, and a back pad secured thereto, wherein the underside of the pad is in form fitting contact with the back of the horse generally across the central surface area of the saddle. Accordingly, the two lower body half sections directly follow the contour of the horse's back and do not form a gullet. The saddle further comprises additional layers of soft leather and foam shaped to define an upwardly extending pommel, an upwardly extending cantle, and a lowered seat area positioned therebetween. The arched and contoured shape of the saddle, therefore, is defined by soft foam and leather and not by a rigid steel or wooden internal frame. Accordingly, the rider is received in a contoured seat which meets international riding regulations and which facilitates the rider in communicating with the horse. Moreover, the flexible form fitting saddle of the present invention provides form fitting comfort for both horse and rider during all phases of movement, regardless of the horse's size or shape.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 1 is a perspective view of a prior art rigid saddletree;

FIG. 2 is a side view of the treeless saddle of the present invention;

FIG. 3 is a side view of two half sections of the saddle body;

FIG. 4 is a top view of the billet straps;

FIG. 9 is a top view of a stirrup hanger;

FIG. 10 is a top view of a pommel trim piece and a cantle trim piece;

FIG. 11 is a top view of the stirrup hanger, the pommel trim piece and the cantle trim piece each secured to the saddle body;

FIG. 12 is a side view of a foam pommel arch;

FIG. 19 is a top view of the front fork cover secured to the pommel cover of FIG. 18;

FIG. 21 is a top view of the pieces of a side panel;

FIG. 22 is a top view of an assembled side panel;

FIG. 23 is a side view of the side panel of FIG. 22 secured to the saddle body of FIG. 20;

FIG. 24 is a top view of the pieces of a bottom cover assembly;

FIG. 25 is a bottom view of the saddle body to which the bottom cover assembly is secured;

FIG. 26 is a bottom view of the bottom cover assembly secured to the saddle body of FIG. 25;

FIG. 27 is a top view of the pieces of a seat assembly;

FIG. 28 is a top view of an assembled seat assembly;

FIG. 29 is a side view of the seat assembly of FIG. 28 secured to the saddle body of FIG. 26;

DETAILED DESCRIPTION

Figure 5:
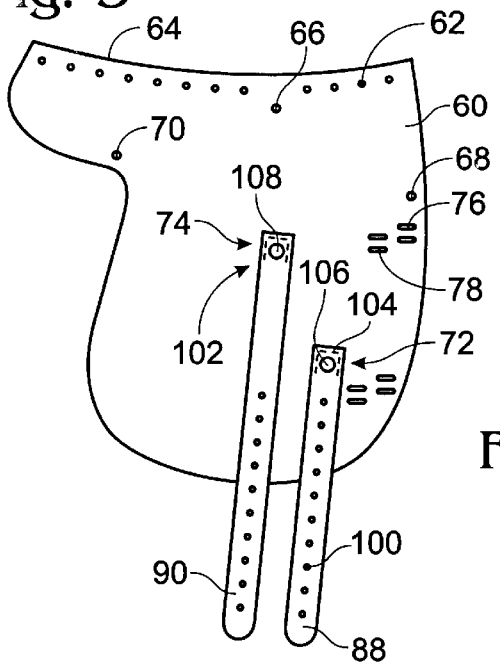
FIG. 5 is a side view of two billet straps secured to a half section of the saddle body.

Referring to FIG. 1, a prior art rigid saddletree 10, also called a tree or a frame, typically is positioned within the outer covering of a prior art saddle (not shown). Rigid saddletree 10 comprises two side bars 12 and 14, an arched front section 16, also called a pommel, and a contoured rear seat 18, also called a cantle. Side bars 12 and 14, pommel 16 and cantle 18 are manufactured of rigid material, typically wood or metal. In the prior art embodiment shown, the frame is manufactured of wood wherein steel braces 20, 22, 24 and 26 are fastened to the individual wooden pieces by fasteners 28 to rigidly secure the frame together. Front steel braces 20 and 22 also include rearward extending hooks 30 for the attachment of stirrups thereto (not shown) for support of the rider's feet. Pommel 16 may also include a steel support brace 32 to ensure the wooden arch holds its shape during use. Pommel 16 further includes two lower points 34 and 36.

In use, side bars 12 and 14 are placed along the back of the horse straddling the spine, wherein the weight of the rider forces the bars downwardly into the horses back and shoulders. This may inhibit the horse's performance and/or lead to injury of the horse's back or shoulders. The frame provides a rigid support base for the rider which isolates the rider from fully sensing the movements of the horse. Moreover, the rigid frame hinders the horse from sensing subtle movements of the rider. Accordingly, in general, the rigid frame inhibits communication between horse and rider.

When the rigid saddletree of the prior art is secured to a horse, the pommel part of the tree is placed over or just rearwardly of, but still in contact with, the back edge of the horse's shoulder blade, also called a scapula, when the horse is in the standing position. The rigid saddletrees of the prior art cannot be placed more rearwardly on a horse because the horse's back becomes too flat so that side bars 12 and 14 would not contact the sides of the horse but instead would stand up on the horse's back.

Upon movement of the horse, the front legs of the horse move forward which rotates the scapula rearwardly and into or under the rigid saddletree. This contact of the horse's scapula with the rigid saddletree can be quite painful. When the horse gallops or canters, the hind end of the horse thrusts upward and forward, thereby thrusting the rigid saddletree and the rider forward. This movement further forces the rigid frame into the horse's shoulders. In particular, lower pointed ends 34 and 36 of the pommel region dig into the horse' shoulders with each stride. Moreover, when a rider places his weight on the stirrups, instead of on the saddle seat, the forward position of the stirrup hooks 30 causes rear cantle 18 to rise up above the horse's back, and causes front pommel 16, and points 34 and 36, to further dig down into the horse's shoulders. The rigid frame construction of the prior art does not allow one to position the saddle rearwardly of the horse's shoulder blades because the scapula acts as a brake on this forward movement of the saddle when weight is placed on the stirrups or when the horse runs.

FIG. 2 shows a preferred embodiment of the flexible treeless saddle 40 of the present invention including an upwardly extending pommel 42, an upwardly extending cantle 44, and a lowered seat portion 46 positioned therebetween. The saddle further comprises an outer side flap 48, billet straps 50 and 52 and a skirt lace 54 for securing a skirt 56 in the fastened position. The method of making the saddle of the present invention will be shown in a step by step fashion.

FIG. 3 shows two mirror image body half sections 58 and 60 which are cut from latigo chard, eight to nine ounce weight leather. As will be understood by those skilled in the art, the saddle of the present invention can be manufactured of any flexible material such as leather, flexible plastic, material, or the like, in any desired weight, strength, color or thickness. The saddle may also be manufactured in any size as is desired for a particular application. Accordingly, Applicant describes herein the method of making the inventive saddle according to preferred embodiment but is not limited to this particular embodiment. Moreover, many of the steps of the method of the present invention involve mirror image steps wherein only one of the mirror image steps is described for the sake of brevity.

Half section 58 is punched with stitching apertures 62 along an upper edge 64 of the section (typically twelve stitching apertures are punched), stirrup hanger aperture 66 in a central portion of the section along upper edge 64, outer side flap rivet apertures 68 and 70, billet strap apertures 72 and 74, and two sets of four knee roll apertures 76 and 78 adjacent a front edge 80 of the half section. This process is then repeated for half section 60. The half sections typically have a width 82 measured along upper edge 64 of approximately eighteen inches, and a length 84 measured from upper edge 64 downwardly to a lower edge 86 of approximately twenty inches.

FIG. 4 shows first set of billet straps 50 and 52 (also called girth attachment straps), and a second set of mirror image billet straps 88 and 90. The billet straps are cut from skirting leather having a weight of twelve to fourteen ounces. Billet strap 50 has a width 92 of one inch and a length 94 of twenty one and three quarters inches. Billet strap 52 has a width 96 of one inch and a length 98 of twenty six and three quarters inches, in one embodiment. Other sized billet straps may be used for different sized horses. Ten girth holes 100 and a rivet hole 102 are punched in each of the billet straps. In the preferred embodiment the billet straps are cut from light brown leather which is edged and then dyed to a black color using standard leather dye as known in the art. The edging process rounds the edges of the billet straps so that the straps are comfortable to handle when securing the girth strap to the saddle. After dying, the edges of the leather strap are rubbed smooth for further ease of handling during use. Each of the leather pieces of the present invention typically are dyed to match one another. Non-dyed leather may also be used.

FIG. 5 shows body half section 60 wherein billet straps 88 and 90 have been glued in place around rivet holes 102 using quick drying all purpose cement. The straps are then stitched to half section 60 by stitching 104 and are riveted in place at billet strap apertures 72 and 74 by rivets 106 and 108. Rivets 106 and 108 typically comprise copper number 9, three quarters inch long rivets.

Figure 6:
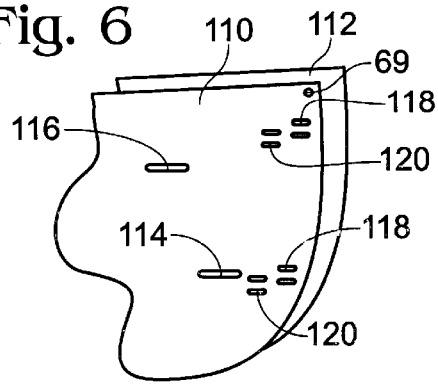
FIG. 6 is a top view of two billet covers.

FIG. 6 shows mirror image billet covers 110 and 112 cut from tumble soft pebble, four to five ounce weight leather. Billet strap apertures 114 and 116, and two sets of four knee roll apertures 118 and 120 are cut or punched in each billet cover. In another embodiment, suede may be used instead of the tumble soft pebble leather.

Figure 7:
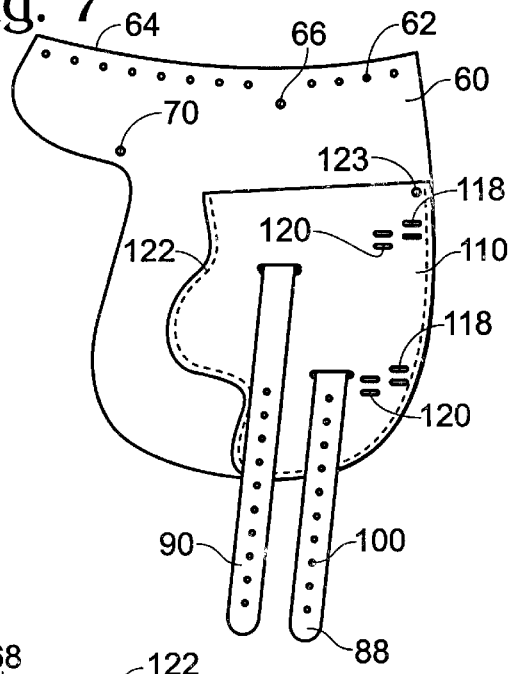
FIG. 7 is a side view of a billet cover sewn to a half section of the saddle body.

FIG. 7 shows billet cover 110 glued and stitched by stitching 122 to half body section 60 wherein billet straps 88 and 90 are pulled through apertures 114 and 116, respectively, and wherein the knee roll apertures in the billet cover are aligned with the knee roll apertures in the half body section. This process is then repeated for the second billet cover and half body section. A rivet aperture 123 is punched in each of the billet covers, the apertures being aligned with apertures 68 of each of the half body sections.

Figure 8:
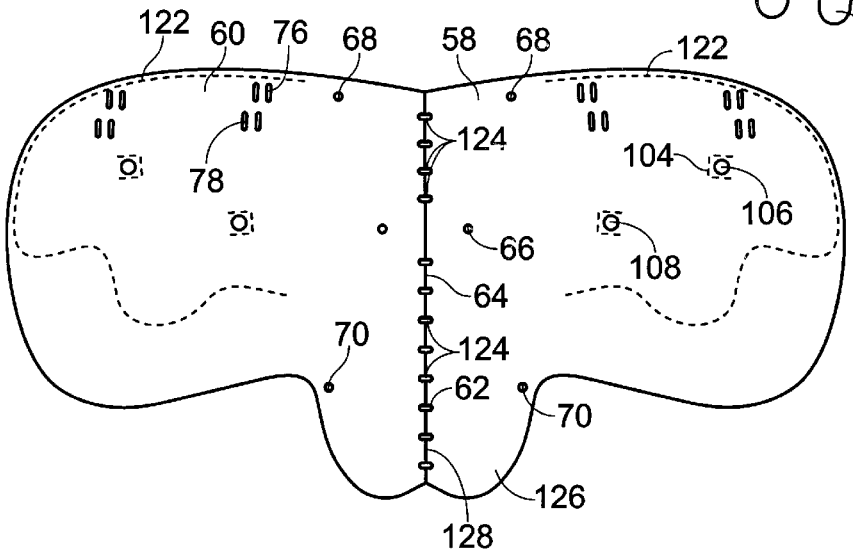
FIG. 8 is a bottom view of the two half sections of the saddle body sewn together.

FIG. 8 shows two half body sections 58 and 60 sewn together using artificial sinue thread by stitching 124. The stitching is tied off individually at each of apertures 62 aligned along top edge 64 of each of the half sections. When the two half sections are sewn together they define a central saddle body 126. Central saddle body 126 does not lay completely flat because upper edge 64 of each of the half body sections has a slight curvature (shown in FIG. 5). Accordingly, central saddle body 126 has an arched shape along its central seam 128. The saddle body can be described as defining a smooth, continuous arched underside adapted for contacting a horse continuously over the horse's spine and throughout the horse's back region. In the preferred embodiment a pad is secured to the underside of the saddle body. Accordingly, the pad the saddle body simultaneously conform to the shape of the horse's back and can therefore both be referred to as "contacting" the horse's back.

FIG. 9 shows a stirrup hanger 130 made from a long leather strap 132 and a short leather strap 134 stitched together by stitching 136 and including rivet apertures 138. The long leather strap captures two break-away stirrup hanger bars 140, which typically are manufactured of a durable and strong material such as metal. Each of the bars measures approximately one inch by one inch and stirrup hanger 130 typically has a length 142 of approximately four inches. Each of bars 140 includes a recess for receiving a stirrup strap as will be understood by those skilled in the art. A rear portion of the recess of bars 140 is open thereby allowing the stirrups to "breakaway" during times of emergency. An aperture 144 is punched through the hanger so as to allow a shroud retainer pin to be received through a central portion of the saddle, as will be described below.

FIG. 10 shows a pommel binding 150 and a cantle binding 152, each cut from tumble soft pebble, four to five ounce weight leather. Pommel binding 150 has a length 154 of approximately twelve inches, and cantle binding 152 has a length 156 of approximately twenty inches.

FIG. 11 shows pommel binding 150 glued to a pommel region 158 of central saddle body 126, and cantle binding 152 glued to cantle region 160 of body 126. Bindings 150 and 152 are glued along their lengths to a top surface 162 of body 126 such that approximately half of each of the bindings is glued to top surface 162 and the other half of each of the bindings extends around and underneath body 126 to an underside 164 of the body. At this step in the method of assembly, the portion of each of the bindings which extends around body 126 to underside 164 remains unglued and loose (as shown at cantle binding 152 in the lower portion of the figure). Rivets 165 are used simultaneously to further fasten leather straps 132 and 134 to each other, which captures stirrup bars 140 therein, and to fasten hanger 130 to central saddle body 126 at apertures 66 so that the hanger straddles central seam 128. The rivets used typically are one inch long copper rivets. Top surface 162 of the saddle body can be described as defining a seat region for receiving a rider thereon, as will be described more fully herein.

FIG. 12 shows a side view of a pre-molded pommel arch 166 manufactured of soft, flexible cross linked polyethylene foam. Non-rigid pommel arch 166 includes a front surface 168 and a top surface 170 extending downwardly toward the rear of the pommel arch.

Figure 13:
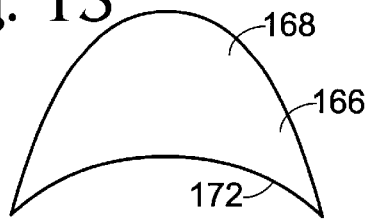
FIG. 13 is a front view of the foam pommel arch of FIG. 12.

FIG. 13 shows a front view of pommel arch 166 including an arched lower surface 172 and front surface 168. In another embodiment, the pommel arch may be manufactured by gluing several layers of foam material together to achieve the preferred shape and size.

Figure 14:
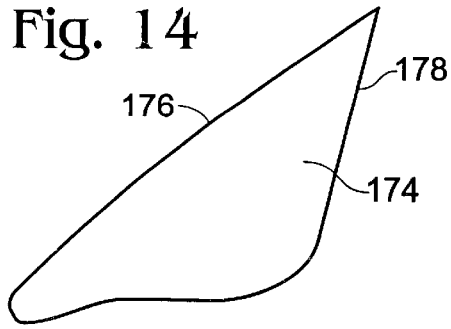
FIG. 14 is a side view of a foam cantle piece.

FIG. 14 shows a side view of a pre-molded cantle 174 having a front sloped surface 176 and a rear surface 178. The non-rigid cantle is manufactured of soft, flexible cross linked polyethylene foam. In another embodiment, the cantle may be manufactured by gluing several layers of foam material together to achieve the preferred shape and size. Other flexible materials besides foam may also be used.

Figure 15:
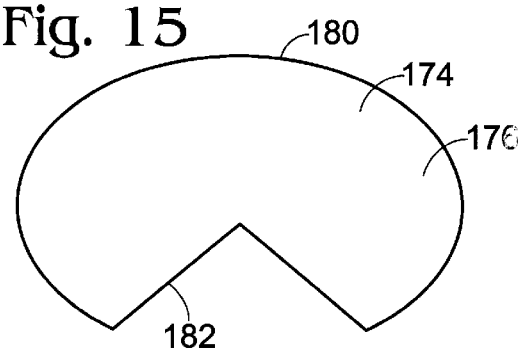
FIG. 15 is a front view of the foam cantle piece of FIG. 14.

FIG. 15 shows a front view of cantle 174 including an upper seat edge 180 and a lower seat edge 182 having a notched shape.

Figure 16:
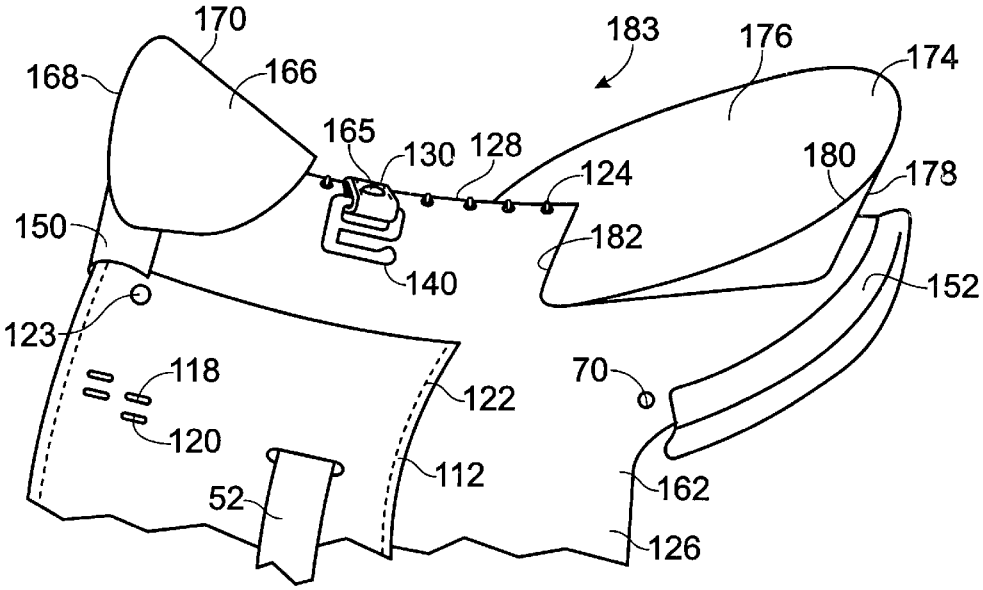
FIG. 16 is a side view of the foam pommel arch and cantle piece each secured to the saddle body of FIG. 11.

FIG. 16 shows pommel arch 166 and cantle 174 glued to top surface 162 of saddle body 126 by quick drying all purpose cement. Pommel arch 166 is positioned over pommel binding 150 and just forward of stirrup hanger 130. Cantle 174 is positioned with rear surface 178 just forward of cantle binding 152. The pommel and the cantle are shown extending upwardly from top surface 162 of saddle body 126. Lower seat edge 182 is centered at central seam 128 of saddle body 126. In the preferred embodiment. which is a small sized saddle, rear surface 178 of cantle 174 is positioned fourteen inches behind the front edge of stirrup hanger 130. The raised pommel and cantle define therebetween a contoured seat region 183, also called a recessed or a form-fitting seat region.

Figure 17:
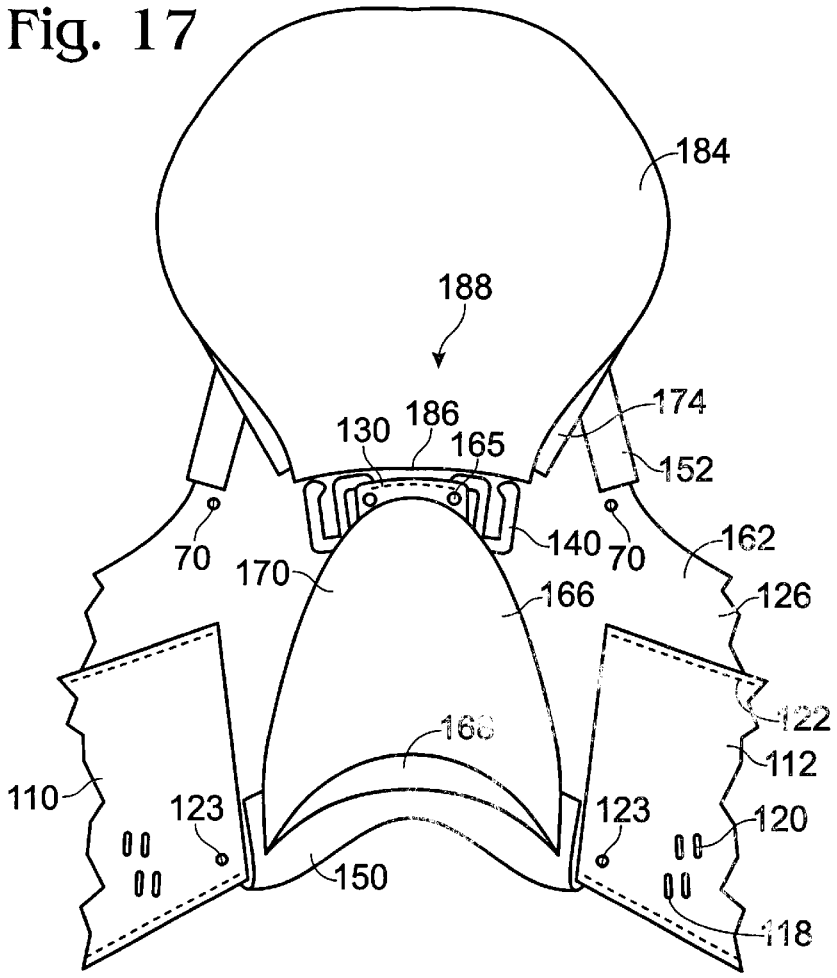
FIG. 17 is a top view of a seat padding secured to the saddle body of FIG. 16.

FIG. 17 shows a seat padding 184 cut from soft, flexible one half inch thick multipurpose low-density continuous rolled foam, hereinafter referred to as MLC foam. Padding 184 has a shape similar to that of front sloped surface 176 of cantle 174, except that padding 184 has a straight lower surface 186 instead of a notch shaped lower edge. Padding 184 is glued in place on front sloped surface 176 of cantle 174 such that straight lower surface 186 abuts stirrup hanger 130. A forward portion 188 of padding 184, i.e., forward of lower seat edge 182 of cantle 174, is glued directly to top surface 162 of saddle body 126.

Figure 18:
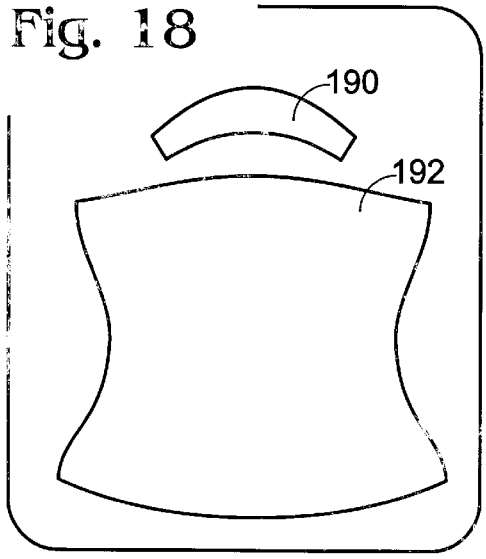
FIG. 18 is a top view of a front fork cover and a pommel cover.

FIG. 18 shows a front fork cover 190 and a pommel cover 192, each cut from tumble soft pebble, four to five ounce weight leather.

FIG. 19 shows front fork cover 190 sewn to pommel cover 192 by stitching 194 (shown at a turned up corner of the covers). Stirrup hanger holes 196 are then punched in pommel cover 192. As will be understood by those skilled in the art, the order of the steps of the present invention can be changed while still resulting in the saddle of the present invention. Accordingly, the order of the steps as recited herein is merely a recitation of the preferred method but other orders of steps may also be used. For example, stirrup hanger holes 196 can be punched in pommel cover 192 before or after the pommel cover is sewn to front fork cover 190.

Figure 20:
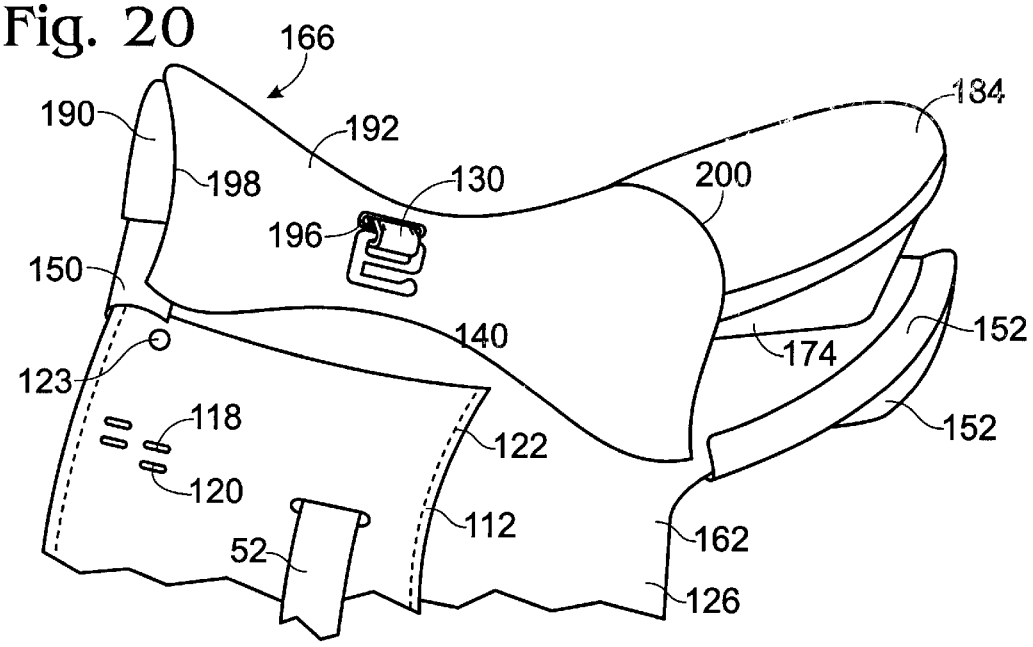
FIG. 20 is a side view of the front fork cover and the pommel cover of FIG. 19 secured to the saddle body of FIG. 17.

FIG. 20 shows front fork cover 190 and pommel cover 192 turned so as to hide stitching 194, thereby defining a seam 198 where the covers meet. The pommel cover is stretched over pommel arch 166 and stirrup hanger bars 140 are pulled through stirrup hanger holes 196. The front fork and the pommel covers are glued in place on pommel 166 with quick drying all purpose cement. In this glued position pommel cover 192 completely covers pommel arch 166 and extends downwardly toward billet cover 112. A rear edge 200 of pommel cover 192 extends rearwardly over straight lower surface 186 of seat padding 184.

FIG. 21 shows the pieces for assembling a side panel of the saddle. The side panel pieces includes a lower front panel 202, a foam panel piece 204, skirting lace 54, an upper front panel 208, and a rear panel 210. Lower and upper front panels 202 and 208 are cut from tumble soft pebble, four to five ounce weight leather. Foam panel piece 204 is manufactured from one quarter inch thick cross linked polyethylene, two pound weight foam. Rear panel 210 is cut from latigo chard, eight to nine ounce weight leather. A rivet hole 212 and a skirt lace slot 214 are cut in each of lower and upper front panels 202 and 208. Additionally, a hallmark 216, indicating the maker of the saddle, is secured to upper front panel 208. The hallmark typically is a small metal tag. A rivet hole 218 is cut in rear panel 210.

FIG. 22 shows the assembly of the side panel of the saddle. To assemble the side panel, foam panel piece 204 is glued in place on lower front panel 202 using quick drying all purpose cement. Upper front panel 208 is then glued and stitched by stitching 220 to foam panel piece 204 and lower front panel 202 to sandwich the foam between the leather panels. The two front panels are then sewn to rear panel 210 by stitching 222. An end 224 of skirting lace 54 is positioned adjacent rivet holes 212 of the upper and lower front side panels. The remainder of the skirting lace is then pulled through skirt lace slots 214. A front edge 226 of the newly formed side panel 228 is trimmed close to stitching 220 of the side panel, as is desired. The foam panel defines a slightly raised region 234 between the upper and lower front panels. The process is then repeated to make a second, mirror image side panel, also called a flap or a fender, of the saddle.

FIG. 23 shows side panel 228 riveted to central saddle body 126 at rivet holes 123 and 70 of the body by rivets 230 and 232 positioned through apertures 212 and 218 of the side panel. Accordingly, in the preferred embodiment, skirting lace 54 is secured to side panel 228 at the same time the side panel is secured to saddle body 126. Rivets 230 and 232 comprise number nine copper three quarters inch long rivets. Other fastening means may also be used, as known in the art.

FIG. 24 shows a bottom foam piece 240 formed from flat, soft, flexible one half inch MLC foam, and a bottom cover 242 cut from tumble soft pebble four to five ounce weight leather. Bottom cover 242 is larger than bottom foam piece 240 so that the bottom cover extends outwardly from the foam piece approximately two inches in each direction when the foam piece is centered on the bottom cover.

FIG. 25 shows saddle body 126, as assembled through the steps shown in FIG. 23, placed upside down in a saddle cradle (not shown) for further manufacturing steps. Underside 164 of saddle body 126 is shown with stitching 124 extending therethrough and along central seam 128. Side panels 228 are shown secured to top surface 162 of body 126 by rivets 230 and 232. Billet strap rivets 106 and 108, and stirrup hanger rivets 165 are also shown on underside 164 of the saddle body. Pommel binding 150 and cantle binding 152 are shown extending from top surface 162 and around the saddle body to underside 164.

FIG. 26 shows bottom foam piece 240 glued to underside 164 of saddle body 126 and bottom cover 242 glued to bottom foam piece 240. In this arrangement, bottom foam piece 240 extends smoothly and continuously across the bottom surface of the saddle body and covers the rivets and stitching which extend through saddle body 126. A perimeter of pad 240 typically is aligned with a perimeter of seat region 183 (FIG. 16), positioned on the top surface of the saddle body. The foam piece also provides comfort for the horse's back in that the foam padding, when the saddle is in use, will conform to and is in continuous contact with the horse's back across the surface area of bottom cover 242. Accordingly, cover 242 may be thought of as a substantially flat, continuous horse backbone ridge contacting surface. The saddle may also be though of as a gulletless saddle because the lower surface of the saddle contacts the horse in its back region continuously over the spine and over the upper portions of the horse's back. In other words, the saddle of the present invention evenly distributes the weight of the rider by contacting the horse continuously throughout the seat or central region of the saddle, instead of merely along two rigid lines on either side of the horse's backbone ridge.

Bottom cover 242 is next sewn to saddle body 126 by stitching 244 positioned outwardly of bottom foam piece 240. Stitching 244 typically secures pommel binding 150 and cantle binding 152 to underside 164 of the saddle body. An outer edge region 246 of bottom cover 242 may extend from the cantle area of the saddle for securement, in a later step, to top surface 162 of saddle body 126.

FIG. 27 shows the pieces required to assemble the seat of the saddle. The pieces include a skirt 250 made from latigo chard, four to five ounce weight leather, a cantle pad 252 made from cross linked polyethylene, one quarter inch thick, two pound weight foam, a cantle cover 254 manufactured of tumble soft pebble, four to five ounce weight leather, and a seat cover 256 manufactured of tumble soft pebble, four to five ounce weight leather. Seat cover 256 is slightly larger than foam pad 252 and has the same diamond type shape. Skirt 250 includes a shroud retainer pin aperture 258 in a central portion of the skirt, and skirt lace apertures 260 positioned adjacent a front, pommel edge 262 of the skirt. The skirt further includes a rear seat edge 264 opposite pommel edge 262.

FIG. 28 shows an assembled seat 266 wherein foam pad 252 has been glued with quick drying all purpose cement to an underside of seat cover 256. The cantle cover 254 is glued to seat cover 256 and then sewn with stitching 268 along a rear edge of the seat cover and the cantle cover. The seat cover is then glued to rear seat edge 264 of skirt 250 and sewn with stitching 270. The skirt is slightly wider at edge 264 than seat cover 256 so that stitching 270 does not extend all the way along edge 264.

FIG. 29 shows assembled seat 266 positioned on seat padding 184 on the upper surface of the saddle for gluing thereto. Before gluing, cantle cover 254 is pulled upwardly and forwardly over seat cover 256 so that stitching 268 is exposed completely along a rear edge 272 of the seat cover. This positioning of cantle cover 254 ensures that seat cover 256 is flat and smooth for gluing to seat padding 184. The seat cover is then hand stretched and smoothed out, and foam pad 252, with seat cover 256 attached thereto, is glued using quick drying all purpose cement to seat padding 184 completely across the undersurface of foam pad 252.

Figure 30:
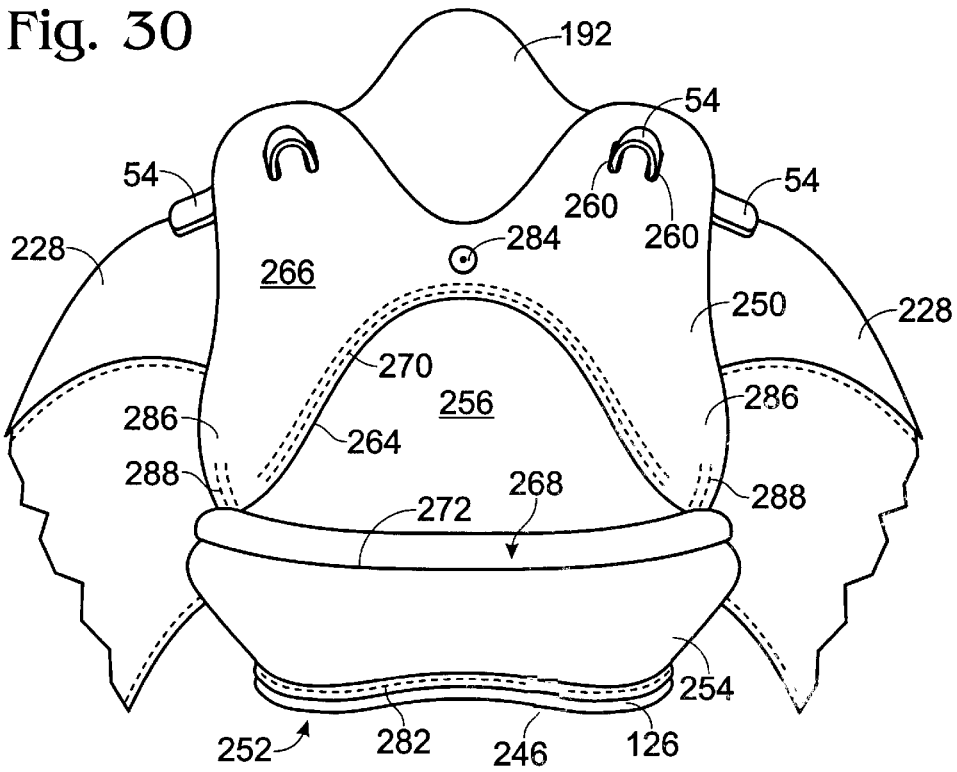
FIG. 30 is a top view of the saddle body of FIG. 29.

FIG. 30 shows outer edge region 246 of bottom cover 242 pulled upwardly and over cantle binding 152 and the rear edge of saddle body 126. The base 280 of cantle cover 254 is then pulled rearwardly and downwardly over rear edge 272 to hide stitching 268. The cantle cover is then sewn to outer region 246 of the bottom cover and through saddle body 126 by stitching 282. This provides a finished rear cantle portion of the saddle of the present invention wherein each of the leather pieces of the cantle region are sewn together.

A shroud retainer pin 284, typically made of resilient plastic or similar material, is then pressed into aperture 258 in skirt 250 and downwardly into stirrup hanger 130. The teeth on pin 284 retain the pin in place thereby providing stability to the saddle, and in particular, securing the front portion of skirt 250 to saddle body 126. The retainer pin typically is coated with polyurethane glue prior to insertion which further aids in retention of the pin in place during the life of the saddle. The retainer pin has a predetermined length so that the tip of the pin is received within aperture 144 (FIG. 9) of stirrup hanger 130 but does not extend downwardly past the stirrup hanger. According, the retainer pin acts as a vertical stabilizer in the saddle of the present invention but does not extend through saddle body 126 or bottom padding 240 (FIG. 26) which may lead to irritation of the horse.

Still referring to FIG. 30, wings 286 of skirt 250 are then hand sewn, using nylon shruso M207 BS black thread stitches 288, to saddle body 126. Skirt laces 54 are then laced upwardly and then downwardly through apertures 260 in skirt 250 to secure the front portion of the skirt to side panels 228.

Figure 31:
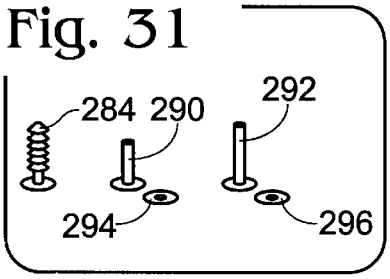
FIG. 31 is a perspective view of the pin and rivets used in assembly of the present invention.

FIG. 31 shows shroud retainer pin 284 and rivets 290 and 292 with corresponding burrs 294 and 296. Rivet 290 comprises a three quarter inch copper number nine rivet. Burr 294 is also manufactured of copper. Rivet 292 comprises a one inch copper number nine rivet. Burr 296 is also manufactured of copper. A one inch rivet typically is used to secure the stirrup hanger to the saddle body. Three quarter inch rivets typically are used to secure the billet straps and the side panels to the saddle body. Other types of fasteners, and other shapes, sizes and materials of the fasteners shown, may also be used in the frameless saddle of the present invention.

Figure 32:
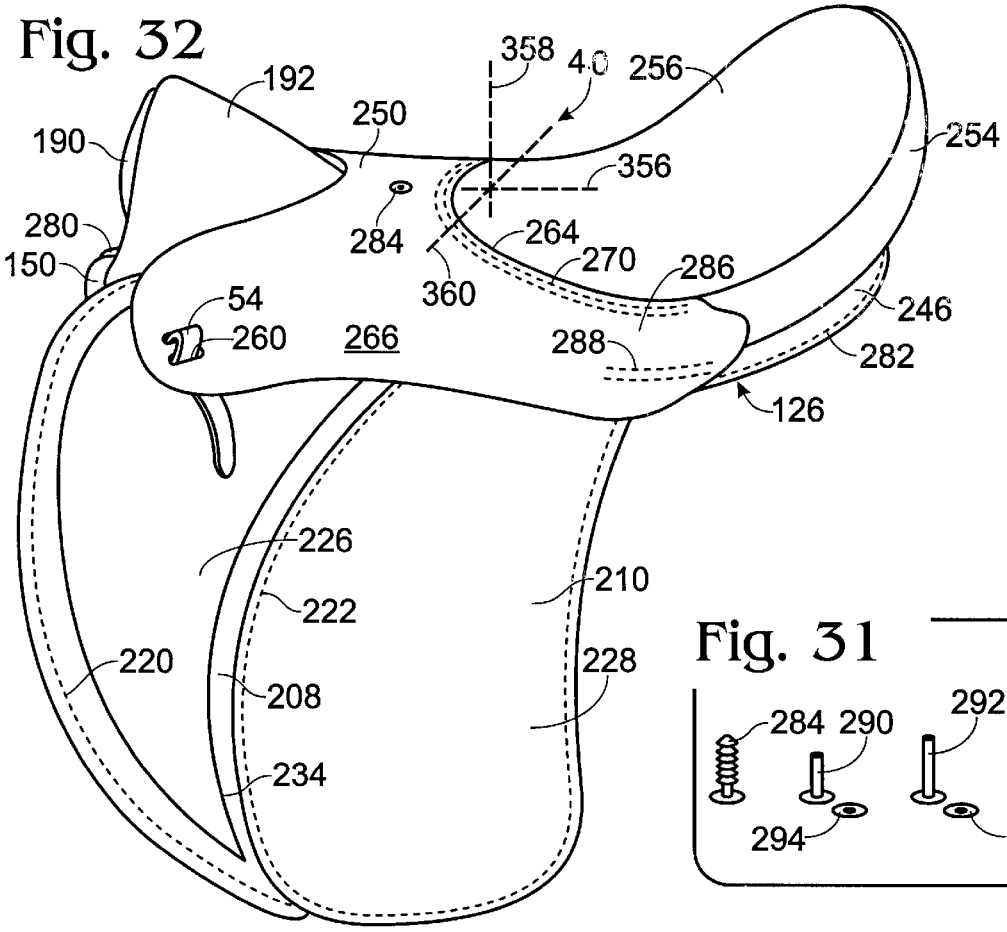
FIG. 32 is a perspective view of the saddle body with the skirt wings secured to the saddle body.

FIG. 32 shows a side view of the saddle of the present invention having been assembled as described in FIGS. 1 through 30. At this stage of assembly, front fork cover 190 of the pommel may be secured to pommel binding 150 by stitching 280.

Figure 33:
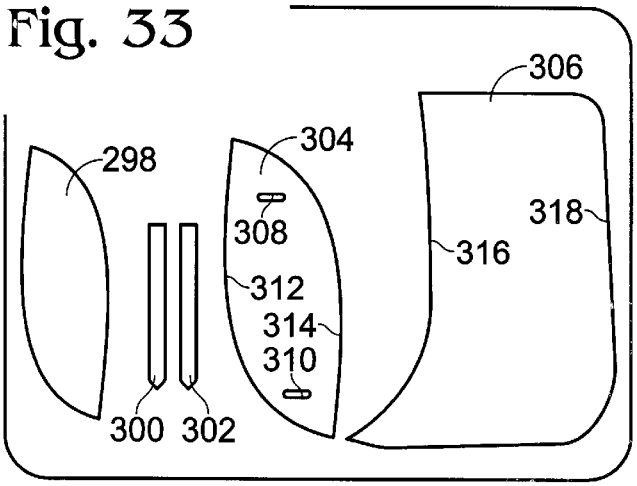
FIG. 33 is a top view of the pieces of a knee roll assembly.

FIG. 33 shows the pieces required for assembly of detachable knee roll pads. The pieces include a foam piece 298 manufactured of Y40, one inch thick shaped foam, two knee roll laces 300 and 302 each cut from latigo chard eight to nine ounce weight leather, a knee roll base 304 cut from latigo chard eight to nine ounce weight leather, and one stretchable cover 306 cut from motorcycle three ounce weight leather. Knee roll base 304 includes two lace apertures 308 and 310 positioned at opposite ends of the base, and first and second side edges 312 and 314. Stretchable cover 306 includes first and second side edges 316 and 318.

Figure 34:
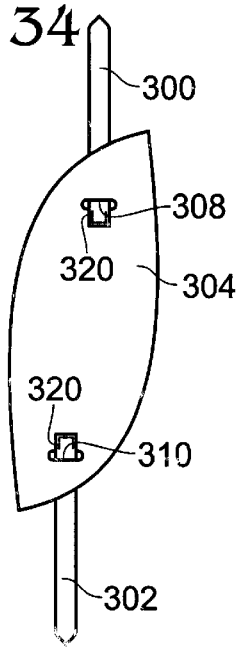
FIG. 34 is a top view of a semi-assembled knee roll assembly.

FIG. 34 shows laces 300 and 302 threaded through apertures 308 and 310 in knee roll base 304, and the laces sewn in place by stitching 320.

Figure 35:
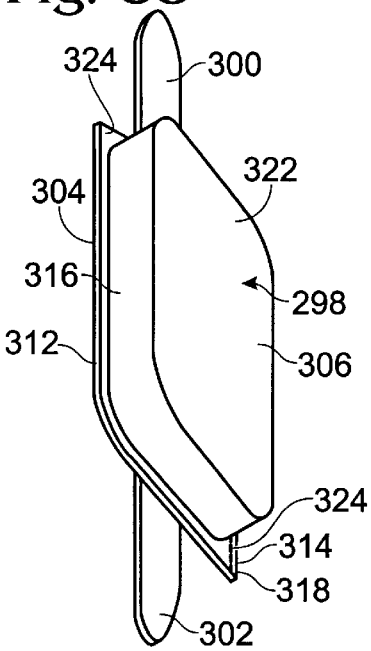
FIG. 35 is a perspective view of an assembled knee roll assembly.

FIG. 35 shows an assembled knee roll assembly 322 wherein first edge 312 of base 304 is glued and sewn to first edge 316 of stretchable cover 306 with the inside surfaces of the base and the cover positioned adjacent one another. The base and the cover are then turned inside out so that their outer surfaces face outwardly and the stitching is hidden within the knee roll assembly, along the front edges of the base and cover. Foam piece 298 is then positioned between and glued to each of base 304 and cover 306. The second edges 314 and 318 of the base and cover, respectively, are then sewn together with stitching 324 to enclose knee roll assembly 322. Any excess amount of leather is then trimmed from second edges 314 and 318 as desired. This process is then repeated to make a second, mirror image knee roll assembly for the other side of the saddle.

Figure 36:
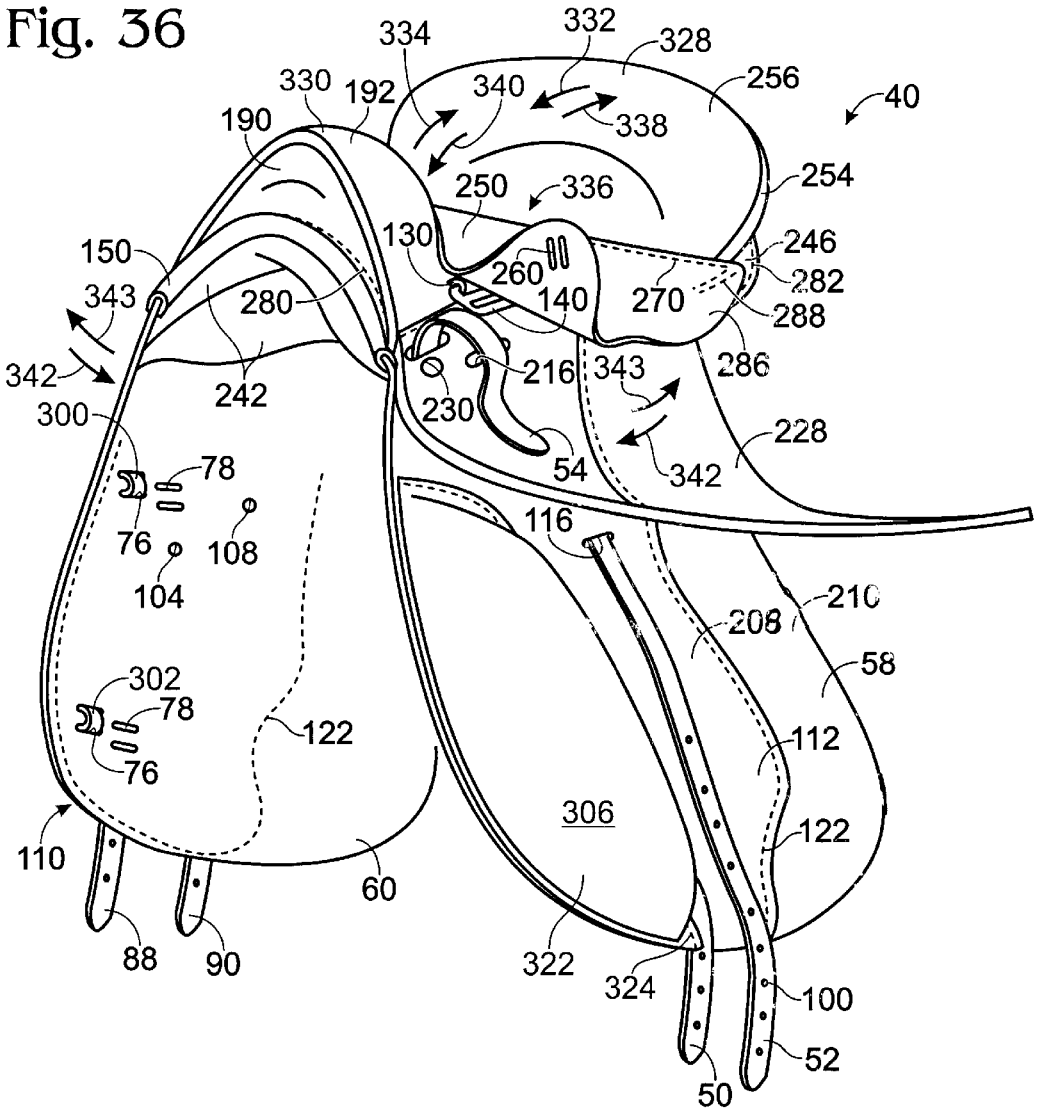
FIG. 36 is a perspective view of a fully assembled saddle of the present invention.

FIG. 36 shows skirt lace 54 removed from skirt apertures 260 to show access to stirrup hanger 130. Side panel 228 is raised to show knee roll assembly 322 and billet straps 50 and 52. The saddle is shown defining a smooth continuous arch for contacting a horse continuously over its spine.

Still referring to FIG. 36, knee rolls 322 are secured to half body sections 58 and 60 over billet covers 1 10 and 112, at apertures 76 or 78 by laces 300 and 302. In this position, the knee roll assemblies are positioned on top of half body sections 58 and 60 but underneath side panels 228. Accordingly, when the side panels are lowered into their normal, relaxed position, the side panels will hide the knee rolls positioned underneath. When the knee roll is secured to apertures 76 of the half body sections, the knee roll assembly will be positioned as far forwardly as possible. This position is ideal for riders having normal to long thigh lengths. When the knee roll is secured to apertures 78 of the half body sections, the knee roll assembly will be positioned backwardly from its forward position. This rearward position is ideal for riders having short to normal to thigh lengths. Moreover, the knee roll assembly may also be secured to the half body sections in an upside down manner to further change the shape that the knee roll assembly provides on the saddle during use.

Saddle 40 shown in FIG. 36 is the fully assembled, treeless, flexible saddle of the present invention. Due to the lack of a rigid frame or tree, saddle 40 is capable of movement in all directions. In other words, a cantle region 328 is capable of upwardly forward movement toward a pommel region 330 in a direction 332, and pommel region 330 is capable of upwardly rearward movement toward cantle region 328 in a direction 334. Such movement, or flexure, of the saddle will tend to lower a seat region 336 with respect to the upwardly extending pommel and cantle regions. The cantle and pommel regions are also capable of downward and outward movement in opposite directions 338 and 340, respectively, so that the saddle will tend to become relatively flatter or more stretched out. Such movement of the saddle may occur during galloping or jumping of a horse on which the saddle is mounted. Saddle 40 of the present invention can also be twisted such that a left portion of cantle region 328 is bent toward a right portion of pommel region 330, or a right portion of cantle region 328 may be bent toward a left portion of pommel region 330. This twisting of the saddle may occur during tight or abrupt turns of the horse. Regardless of the flexure or contortions through which the saddle moves, seat region 336 generally will be positioned lower than pommel region 330 and cantle region 328 such that the rider fits comfortably and securely within the saddle. The raised positioning of the pommel and cantle of the present invention, which forms a contoured seat for the rider, is due to foam pads, rather than the upward extensions of a rigid frame or tree.

Due to the slight curvature of upper edges 64 of the half body sections, seam 128 of the saddle body has an arched shape similar to that of a horse's back. Accordingly, the treeless saddle of the present invention generally retains its arched shape without the need for a rigid tree or frame. Moreover, the side panels of the saddle may each move inwardly in directions 342 or outwardly in directions 343 to accommodate horses of varying sized girths, and to move in response to the breathing and striding of the horse.

Due to the treeless, flexible nature of saddle 40, the only material positioned between the rider and the horse is flexible leather and foam pads. This construction provides increased comfort to both horse and rider and reduces the chance of injury to the horse's back or shoulders. Moreover, due to the flexible nature of the saddle, which moves in conformity with each and every movement of the horse, the treeless flexible saddle of the present invention allows a rider to instantly feel the horses movements, and allows the horse to instantly sense the movements of the rider, thereby allowing the rider to ride in a state of complete harmony and communication with his horse.

The saddle shown in FIG. 36 is not shown with a girth or stirrups attached. These elements typically must be used with the saddle to secure the saddle to a horse and to provide for safe riding of the horse, as will be understood by those skilled in the art.

Figure 37:
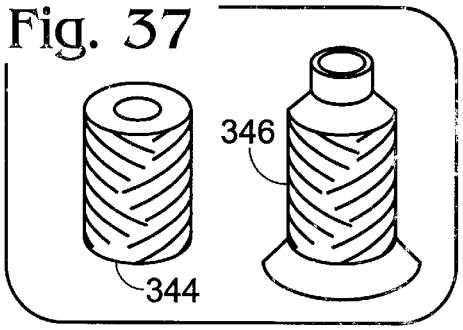
FIG. 37 is a perspective view of threads used in the assembly of the present invention.

FIG. 37 shows artificial sinue thread 344 and nylon shurso M207 or M277 black thread 346 used in the preferred assembly method of the present invention. Those skilled in the art will understand that any type of thread or other fastening means may also be used in the assembly steps of the present invention.

Figure 38:
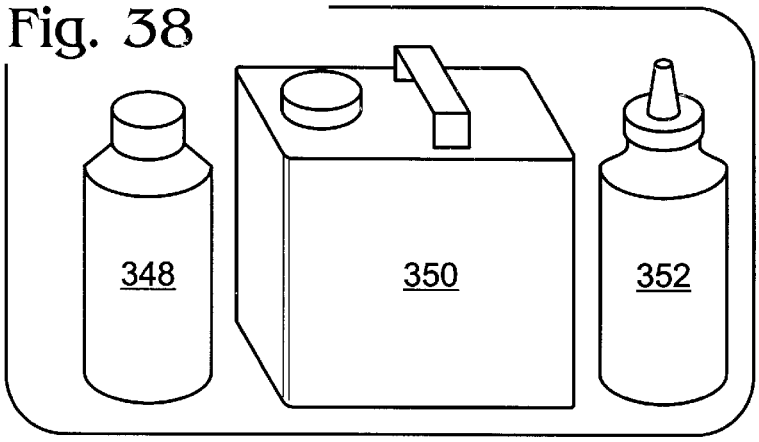
FIG. 38 is a perspective view of the dye, cement and glue used in the assembly of the present invention.

FIG. 38 shows black leather dye 348, quick drying all purpose cement 350, and polyurethane glue 352.

The leather pieces of the saddle of the present invention typically are dyed a black color before assembly. However, the leather may be dyed any color as is desired for a particular customer. Moreover, the saddle of the present invention may be manufactured in any size and with modifications to the method described herewith, while still retaining the invention features of the present invention.

Referring again to FIG. 32, saddle 40 defines first, second and third axes 356, 358, and 360, respectively, each positioned perpendicular to each other. Axis 356 extends horizontally through the cantle and the pommel. Axis 358 extends vertically through the seat. Axis 360 extends horizontally between the cantle and the pommel. The saddle is flexible individually and simultaneously along each of the first, second and third axes. In other words, the pommel and the cantle may be bent towards each other about axis 360. The side panels may be bent toward or away from each other about axis 356. The pommel and the cantle may also be bent toward each other about axis 358 such that the saddle is "turned" toward a left or a right direction. Moreover, due to the fully flexible, treeless construction of the present invention, the saddle may be bent or twisted in either or all of these directions simultaneously.

During use, when a rider places his weight on stirrups attached to stirrup hanger 130, the stirrup hanger will be pulled downwardly, and due to the full contact of the saddle underside with the horse's back, the full surface area of the flexible saddle will be pulled downwardly against the horse's back. The pommel and cantle regions may each rise slightly (in other words, the seat may be compressed with respect to the pommel and cantle) but this further defines and enhances the contoured seat in which the rider sits. Accordingly the flexible saddle of the present invention is similar to a flexible raft: when a person stands anywhere in a flexible raft, both ends of the raft may rise but the bottom of the raft will remain in contact with the surface of the water and the boater is not forced forwardly or rearwardly but merely sinks a little deeper into the raft. In contrast, the rigid saddletree of the prior art is like a rigid boat: when a person stands near a front end of the boat, the rear end of the boat is raised and the boater is thrust forward; and when the person stands at the rear of the boat the front end of the boat will rise and the boater is thrust rearward. Similarly, the motion of the rigid frame in response to movements of a horse, or by placing weight in the stirrups, forces the rider either rearwardly which hinders control of the horse, or forwardly, wherein the frame points dig into the horse's shoulders.

Figure 39:
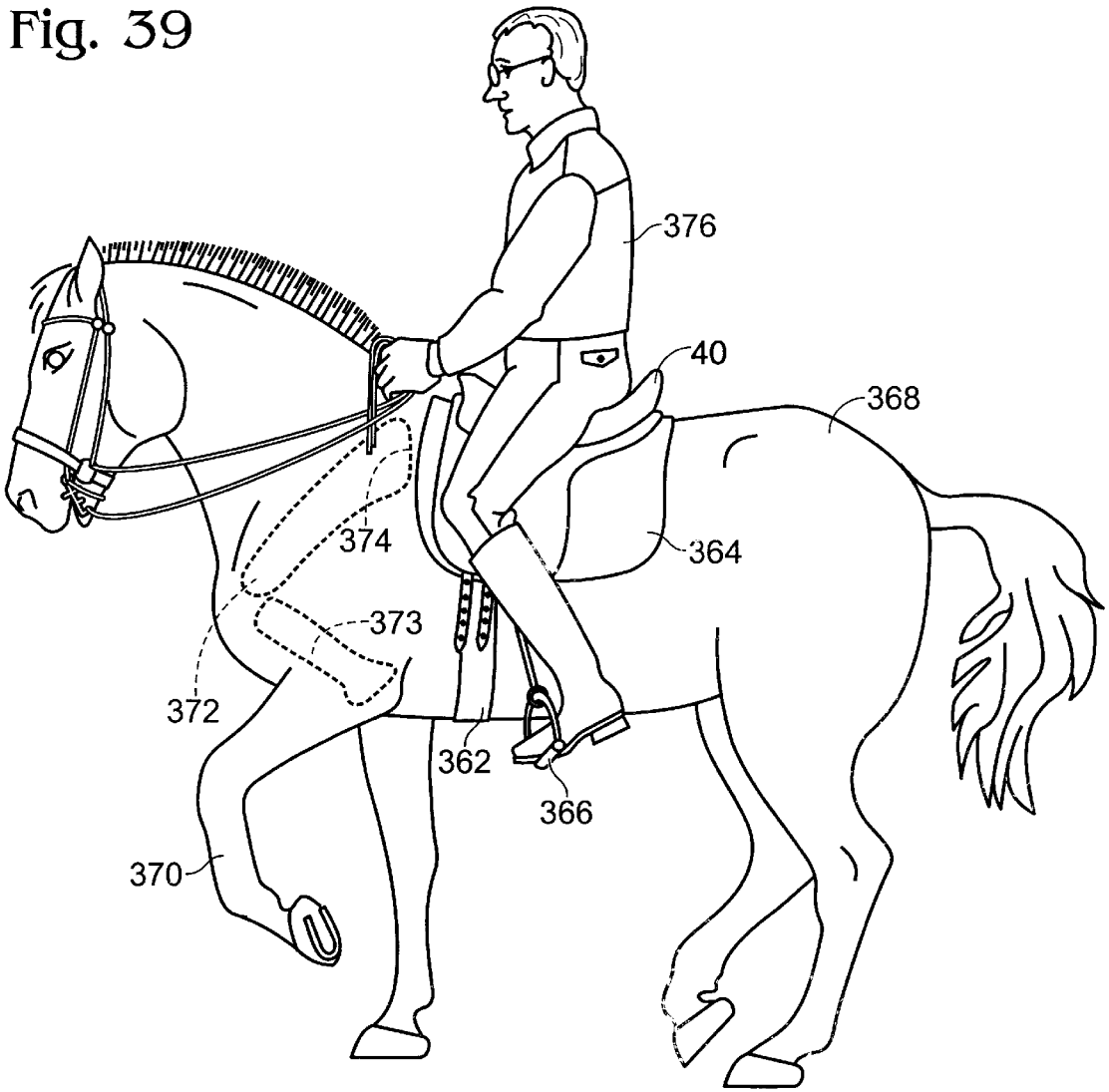
FIG. 39 is an environmental view of the preferred saddle of the present invention secured on a horse.

FIG. 39 shows the saddle of the present invention secured to a horse. In particular, saddle 40 is shown secured by a girth strap 362 on a horse, with a soft saddle pad 364 positioned between the saddle and the horse. Stirrups 366 are secured to the stirrup hanger. The saddle preferably is secured to the horse rearwardly of the scapula of the horse, by at least two inches, when the horse is in the standing position. In this figure a horse 368 is shown with its front left leg 370 elevated, such that its scapula 372 is rotated rearwardly, also referred to a posterior oscillation of the scapula. The humerus 373 is rotated forwardly thereby closing the angle between the scapula and the humerus. In this elevated leg position, a rear edge 374 of scapula 372 is positioned forwardly of saddle 40 so that the saddle does not contact or rub against the shoulders of the horse even during periods of movement. The raised pommel and cantle are shown providing a contoured seat area for receiving a rider 376.

Figure 40:
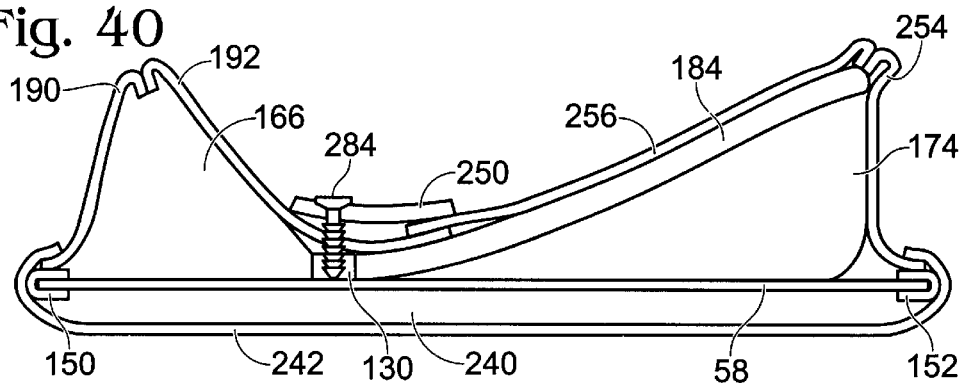
FIG. 40 is a side cross sectional view of the saddle of the present invention.

FIG. 40 is a side cross section view of the saddle showing the layering system of the present invention.

While preferred embodiments of the present invention have been shown and described, it will be apparent to those skilled in the art that many changes and modifications may be made without departing from the invention in its broader aspects. The appended claims are intended to cover, therefore, all such changes and modifications as fall within the true spirit and scope of the invention.

I claim:

1. A flexible, treeless and gulletless saddle comprising:

a non-rigid saddle body manufactured of flat, flexible material and having a lower surface that defines a smooth, continuous arch adapted for contacting a horse continuously over the horse's spine, and a top surface that defines a seat region;

a non-rigid pommel manufactured of flexible material, secured to said top surface, and extending upwardly from said seat region; and a non-rigid cantle manufactured of flexible material, secured to said top surface, and extending upwardly from said seat region opposite said pommel such that said pommel, said cantle and said seat region define a contoured seat adapted for receiving a rider.

2. The saddle of claim 1 wherein said pommel comprises a solid piece of flexible foam directly secured to said saddle body, and wherein said cantle comprises a solid piece of flexible foam directly secured to said saddle body.

3. The saddle of claim 1 further comprising a flat, flexible bottom pad secured continuously across a central region of said lower surface, said bottom pad adapted for contacting a horse continuously over the horse's spine.

4. The saddle of claim 1 further comprising a flexible pommel cover and a flexible cantle cover each secured to said saddle body in a central portion of said seat region by a single fastener.

5. The saddle of claim 4 wherein said flexible pommel cover is further secured to said saddle body by stitching, and said flexible cantle cover is further secured to said saddle body by stitching.

6. The saddle of claim 1 further comprising a side panel and a stirrup hanger each secured to said non-rigid saddle body.

7. The saddle of claim 6 wherein said stirrup hanger comprises first and second stirrup bars connected by a flexible material, and wherein said stirrup hanger is secured to said saddle body in a central portion of said seat region.

8. A method of manufacturing a fully flexible saddle, comprising the steps of:

providing a flat, first saddle body portion;

providing a flat, second saddle body portion;

securing said first and second saddle body portions together to provide a saddle body defining a smooth arched underside having a central region and a smooth arched topside, wherein said central region of the underside is adapted for contacting a horse continuously throughout said central region;

providing a flexible pommel;

securing said pommel to said topside of said saddle body such that said pommel extends upwardly from said topside;

providing a flexible cantle; and securing said cantle to said topside of said saddle body such that said cantle extends upwardly from said topside, wherein said pommel, said cantle and said topside together define a recessed seat region between said pommel and said cantle.

9. The method of claim 8 further comprising the steps of providing a seat cover including a skirt, and securing said skirt to said saddle body with a skirting lace.

10. The method of claim 8 further comprising the steps of providing billet straps, and securing said billet straps directly to said saddle body.

11. The method of claim 8 wherein said pommel is manufactured of solid, flexible foam, and said cantle is manufactured of solid, flexible foam.

12. The method of claim 8 further comprising providing side panels, and securing said side panels directly to said saddle body.

13. The method of claim 8 further comprising providing a stirrup hanger, and securing said stirrup hanger to said saddle body in a central region of said topside.

14. The method of claim 8 wherein a perimeter of said seat region of the topside is aligned with a perimeter of said central region of the underside.

15. The method of claim 8 further comprising the steps of providing a seat cover including a skirt, and securing said skirt to said saddle body with a retainer pin positioned centrally within said seat region.

16. A frameless, flexible saddle comprising:

a substantially flat, bendable saddle body defining a substantially flat, continuous horse backbone ridge contacting surface and a seat region positioned opposite said backbone ridge contacting surface; and a flexible cantle secured to and extending upwardly from said seat region, wherein said saddle body includes first, second and third axes each positioned perpendicular to one another, and wherein said flexible saddle is flexible individually and simultaneously along each of said first, second and third axes.

17. The flexible saddle of claim 16 further comprising a flexible pommel secured to and extending upwardly from said seat region opposite said flexible cantle.

18. The flexible saddle of claim 16 wherein the saddle is manufactured by the process of layering leather and foam, in the absence of a rigid tree.

19. The flexible saddle of claim 16 wherein the rigid materials of the saddle consist essentially of retainer pins, stirrup bars, and rivets.

20. The flexible saddle of claim 16 further comprising a seat cover secured to said saddle body by a pin positioned in a central portion of said seat region and by lacing positioned on opposing sides of a pommel region of the saddle body.

21. The flexible saddle of claim 16 wherein when said saddle is secured to a horse, said saddle is positioned rearwardly of and does not contact a scapula region of said horse.

* * * * *